US009546844B2

(12) United States Patent
Hall et al.

(10) Patent No.: US 9,546,844 B2
(45) Date of Patent: Jan. 17, 2017

(54) CONVERTED MUZZLELOADER ARROW GUN

(71) Applicant: Ardesa, S.A., Zamudio-Vizcaya (ES)

(72) Inventors: Thomas F. Hall, Higganum, CT (US); Angel Calvete, Zamudio-Vizcaya (ES)

(73) Assignee: Ardesa, S.A., Zamudio-Vizcaya (ES)

( * ) Notice: Subject to any disclaimer, the term of this patent is extended or adjusted under 35 U.S.C. 154(b) by 0 days.

(21) Appl. No.: 14/445,365

(22) Filed: Jul. 29, 2014

(65) Prior Publication Data

US 2016/0033231 A1 Feb. 4, 2016

(51) Int. Cl.
*F41C 7/00* (2006.01)
*F41C 9/08* (2006.01)
*F41C 7/11* (2006.01)

(52) U.S. Cl.
CPC .. *F41C 9/08* (2013.01); *F41C 7/11* (2013.01)

(58) Field of Classification Search
CPC ..... F41C 9/08; F41C 9/085; F41C 27/06; F41A 3/58; F42B 30/14; F41F 7/00
USPC ..... 42/51, 105; 89/1.3
See application file for complete search history.

(56) References Cited

U.S. PATENT DOCUMENTS 1,907,273 A 5/1933 Ulming
2,789,465 A * 4/1957 McDonald ..... F41C 9/06 124/57
3,583,087 A * 6/1971 Huebner ..... F42B 12/68 102/530
3,610,091 A * 10/1971 Bornand ..... F42B 30/04 102/472
4,890,597 A 1/1990 Ekstrom
5,086,749 A 2/1992 Ekstrom
5,623,779 A * 4/1997 Rainey, III ..... F41C 9/08 42/51
5,811,713 A * 9/1998 Gudgel ..... F41C 27/06 102/504
8,087,406 B2 1/2012 Axelsson
8,210,161 B2 7/2012 Mattos
2005/0108916 A1* 5/2005 Keeney ..... F41A 21/02 42/76.02
2005/0188979 A1 9/2005 Berry
2008/0282596 A1* 11/2008 DeLeeuw ..... F41A 3/58 42/51
2010/0229446 A1* 9/2010 Ibarguren ..... F41A 3/58 42/51
2010/0281732 A1* 11/2010 Laney ..... F41C 7/11 42/8

(Continued)

*Primary Examiner* — Gabriel Klein
(74) *Attorney, Agent, or Firm* — Robert Curcio; DeLio, Peterson & Curcio, LLC

(57) ABSTRACT

A muzzleloader firearm is converted into a firearm adapted for firing an arrow. The stock assembly of the muzzleloader firearm is retained while the barrel assembly is completely removed, and replaced by an arrow barrel assembly. The arrow barrel assembly has a stock assembly attachment for releasably engaging the stock assembly of the muzzleloader firearm, and a barrel attachment for engaging an inner barrel tube that holds an arrow shaft with a hollow interior and propels the arrow out of the firearm when a blank cap is activated, and an outer shroud to protect the inner barrel tube and enclose a loaded arrow. The arrow barrel assembly rearward end has formed recesses for receiving the blank cap and aligning the rim of the blank cap with the firing pin of the muzzleloader stock assembly.

8 Claims, 11 Drawing Sheets

(56) References Cited

U.S. PATENT DOCUMENTS

| | | | | |
|---|---|---|---|---|
| 2014/0033588 | A1* | 2/2014 | Laney | F41C 9/08<br>42/51 |
| 2014/0090285 | A1* | 4/2014 | Peterson | F41A 3/00<br>42/51 |

* cited by examiner

CONVERTED MUZZLELOADER ARROW GUN

BACKGROUND OF THE INVENTION

1. Field of the Invention

The present invention relates to an arrow gun, and specifically to the conversion of muzzleloader firearm into a firearm adapted for firing an arrow.

2. Description of Related Art

Guns adapted to propel arrows have been known in the art. Early designs adapted bows to gun frames and used a trigger mechanism for holding the string of the bow taut, with an arrow fitting into a groove in the gun frame and engaged by the string, so that when the trigger was released, the arrow would be propelled from the gun. This type of design was taught in U.S. Pat. No. 1,907,273 issued to Umling on May 2, 1933, titled "Arrow Gun."

In more recent models, guns using compressed gas as an energy source for propelling an arrow have replaced string propulsion. The compressed gas is typically stored in a tank or a gas cartridge. In U.S. Pat. No. 8,087,406, issued to Axelson on Jan. 3, 2012, titled "Gun Using Compressed Gas to Propel An Arrow," a hollow barrel is adapted to accommodate an arrow, the barrel having an open rearward end and an open forward end, and a cylindrical chamber with a gas inlet for connecting the chamber to the source of the gas, as well as a gas outlet from which the barrel extends. This prior art invention provides a hermetically sealed cylindrical chamber that encloses the open rear end of the barrel and allows relative movement between the chamber and the barrel, the open rearward end of the barrel being sealed by the closed rearward end of the cylindrical chamber in the non-firing position, such that air may enter the barrel via the open rearward end of the barrel in the firing position.

In U.S. Patent Publication 2005/0188979 of Berry, published Sep. 1, 2005, titled "Arrow Gun Method and Apparatus," a gun using compressed gas is taught. The compressed gas originates from a gas cartridge to propel an arrow. A barrel received the hollow shaft of the arrow, and a compressed gas storage chamber is adapted to receive and store the compressed gas in an expanded state from the compressed gas cartridge for later relief.

U.S. Pat. No. 5,086,749 issued to Ekstrom on Feb. 11, 1992, titled "Arrow Gun," teaches a gun with a compressed gas source, such as compressed air or $CO_2$, a high pressure air passageway for linking the barrel to the gas source to propel an arrow.

In the aforementioned prior art, either taut string or compressed gas stored in cartridges is the propellant for launching an arrow from a gun frame.

The popularity of hunting with a muzzleloading firearm has grown dramatically. The largest growth took place after states began special muzzleloader only seasons. These regulations have drawn many modern hunters into trying muzzleloaders. Now, thousands of hunters take advantage of these extended seasons each year.

In the Western states in particular, there are special muzzleloader seasons that traditionally coincide with the peak of the elk rut. Licenses are limited, so there are few hunters in the woods. Depending on the location and the skill of the caller, bulls can be bugled in to close ranges, which lends to hunting with muzzleloaders and crossbows. Typically a hunter can find a standalone muzzleloading season, or in some cases a "primitive weapons" season that may encompass muzzleloaders, crossbows, and slingshots.

Additionally, some hunters have taken to spear fishing with crossbows. This relatively new hunting interest has promoted an interest in crossbows and arrow guns.

Some muzzleloading hunters take a traditional approach, using old-style weapons and equipment; however, modern inline muzzleloaders offer better accuracy and reliability. They often come in break action, which makes cleaning easier and protects the ignition system from moisture. And they can be mounted with telescopic sights.

Before this development, firearms used flintlock ignition systems which produced flint-on-steel sparks to ignite a pan of priming powder and thereby fire the gun's main powder charge (the flintlock mechanism replaced older ignition systems such as the matchlock and wheellock). Flintlocks were prone to misfire in wet weather, and many flintlock firearms were later converted to the more reliable percussion system or caplock system.

Percussion caps replaced flintlock ignition systems chiefly as a means to allow a muzzleloader firearm to fire in any weather. The percussion cap is a generally small cylinder of copper or brass. Inside is a small amount of a shock-sensitive explosive material such as fulminate of mercury or a non-corrosive compound such as lead styphnate. The percussion cap is placed over a hollow metal nipple at the rearward or breech end of the gun barrel. The nipple contains a tube which goes into the barrel. The firearm hammer strikes the percussion cap and ignites the explosive primer by concussion. The flame travels through the hollow nipple to ignite a main powder charge.

Traditional muzzleloaders come in both caplock (percussion) and flintlock design, with the flintlock being the more challenging of the two.

Although adapting a gun to have the capability of shooting an arrow is known in the art, specifically with guns propelling arrows by compressed air using a compressed air source, adapting, or more precisely, converting a muzzleloader to have this capability represents a novel alternative to the compressed air arrow gun. The advantages and uniqueness of muzzleloader firearms are realized by a muzzleloader arrow gun.

SUMMARY OF THE INVENTION

It is an object of the present invention to provide a converted muzzleloader firearm capable of accurately firing an arrow.

It is another object of the present invention to provide an efficient conversion method for converting a muzzleloader firearm to a muzzleloader arrow gun. A conversion that may be performed in the field under adverse conditions.

The above and other objects, which will be apparent to those skilled in the art, are achieved in the present invention which is directed to a muzzleloader arrow gun comprising: a break open muzzleloader firearm stock assembly having a frame, a muzzleloader firing action, and a rear stock; and an arrow barrel assembly having a rearward end and a forward end, releasably attachable to the muzzleloader stock assembly, the arrow barrel assembly replacing a muzzleloader barrel assembly of the muzzleloader firearm, the arrow barrel assembly including: a stock assembly attachment at the arrow barrel assembly rearward end for releasably engaging the stock assembly of the muzzleloader firearm; a barrel attachment; and a barrel tube having open ends, an inner diameter, and an outer diameter, releasably engaging the barrel attachment, the outer diameter of the barrel tube adapted to fit within an arrow shaft having a hollow inner core, the barrel tube attached to the barrel attachment.

The arrow barrel assembly includes an outer shroud releasably engaging the barrel attachment, the outer shroud coaxial with the barrel tube and having a larger diameter than the outer diameter of the barrel tube.

The arrow barrel assembly includes a barrel segment having a rearward end, a forward end, and a cylindrical cavity traversing from the barrel segment rearward end to the barrel segment forward end, the cylindrical cavity coaxially aligned with the barrel tube inner diameter, the barrel segment rearward end face having a first cylindrical recess larger than and coaxial with the cylindrical cavity for receiving a rim of a blank rimfire cartridge, or for receiving a power load used for example in power actuated tools, such as nail guns. The cylindrical cavity having a second cylindrical recess of a diameter smaller than the first cylindrical recess and larger than the cylindrical cavity diameter for receiving the cylindrical body of the power load or blank rimfire cap when the power load is inserted within the first cylindrical recess.

The barrel segment forward end forms the barrel attachment for securing the barrel segment to the barrel tube, the forward end of the barrel segment having a cylindrical aperture, coaxial with and having diameter equal to or larger than the cylindrical cavity diameter for insertion of the barrel tube. The barrel segment forward end includes an outer surface having threaded grooves for receiving complementary threaded grooves of an outer shroud, the outer shroud releasably engaging the barrel segment, which effectively extends the shroud.

A barrel lug may be fixedly attached to the barrel segment for securing the arrow barrel assembly to the frame within the muzzleloader stock assembly, the barrel lug having an angular cutout in a rearward end for engaging a complementary angular projection of an upper portion of a rotatable barrel catch of the stock assembly, and an arcuate cutout in a forward end for rotatably engaging a pivot pin on the frame of the stock assembly.

The arrow barrel assembly may further include a fixation component for attaching a forend stock to the arrow barrel assembly, the fixation component having apertures for receiving screws, pins, or any combination thereof for attachment.

In a second aspect, the present invention is directed to a muzzleloader arrow gun comprising: a muzzleloader firearm stock assembly having a receiver or frame, a muzzleloader firing action or mechanism, and a rear stock; and an arrow barrel assembly comprising: a monoblock having a rearward end, a forward end, and a cylindrical cavity traversing therethrough; a stock assembly attachment adjacent the monoblock for securing the arrow barrel assembly to the stock assembly; a barrel attachment for securing the monoblock to an inner barrel tube and an outer shroud; the inner barrel tube insertable within or attachable to the barrel attachment, the inner barrel tube having open ends, an inner diameter, and an outer diameter, the outer diameter adapted to fit within an arrow shaft having a hollow inner core; the outer shroud coaxial with and encompassing the inner barrel tube and releasably engaged with the barrel attachment.

The barrel lug may include an angular cutout in a rearward end for engaging a complementary angular projection of an upper portion of a rotatable barrel catch, and an arcuate cutout in a forward end for rotatably engaging a pivot pin on the frame of the stock assembly.

The barrel lug may further include a slot for receiving an extractor, the extractor having a raised end with a notch such that when the extractor is inserted within the slot, the raised notch forms a predetermined gap for slidably contacting and moving a blank rimfire cap or power load of a predetermined caliber.

The monoblock may comprise a barrel segment having a forward end and a rearward end, the barrel segment forward end forming the barrel attachment, the cylindrical cavity having a first diameter at the barrel segment forward end to insertably receive the inner barrel tube outer diameter, the cylindrical cavity having a second diameter approximately equal to the inner barrel tube inner diameter extending the inner barrel tube inner diameter substantially through the barrel segment.

The barrel segment may include outer threads at the barrel segment forward end, and the outer shroud may include a complementary threaded portion at a breech end, the outer shroud threaded portion threadingly engaging the barrel segment outer threads.

The muzzleloader firearm stock assembly is a stock assembly from a break open muzzleloader firearm and may include an insert to assist in firing pin alignment. The arrow barrel assembly replaces the muzzleloader barrel assembly of the break open muzzleloader firearm upon conversion to an arrow gun.

In a third aspect, the present invention is directed to a method of converting a muzzleloader firearm to a muzzleloader arrow gun, the method comprising: providing a muzzleloader firearm having a stock assembly and a muzzleloader barrel assembly; removing the muzzleloader firearm barrel assembly from the stock assembly; replacing the muzzleloader firearm barrel assembly with a muzzleloader arrow barrel assembly, the muzzleloader arrow barrel assembly including: a barrel segment having a rearward end, a forward end, and a cylindrical cavity traversing therethrough; a stock assembly attachment adjacent the barrel segment for securing the arrow barrel assembly to the muzzleloader stock assembly; an inner barrel tube insertable within or attachable to the barrel segment, the inner barrel tube having open ends, an inner diameter, and an outer diameter, the outer diameter adapted to fit within an arrow having a hollow inner core; and an outer shroud coaxial with and encompassing the inner barrel tube and releasably engaged with the barrel attachment.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-12 of the drawings in which like numerals refer to like features of the invention.

Figure 1:
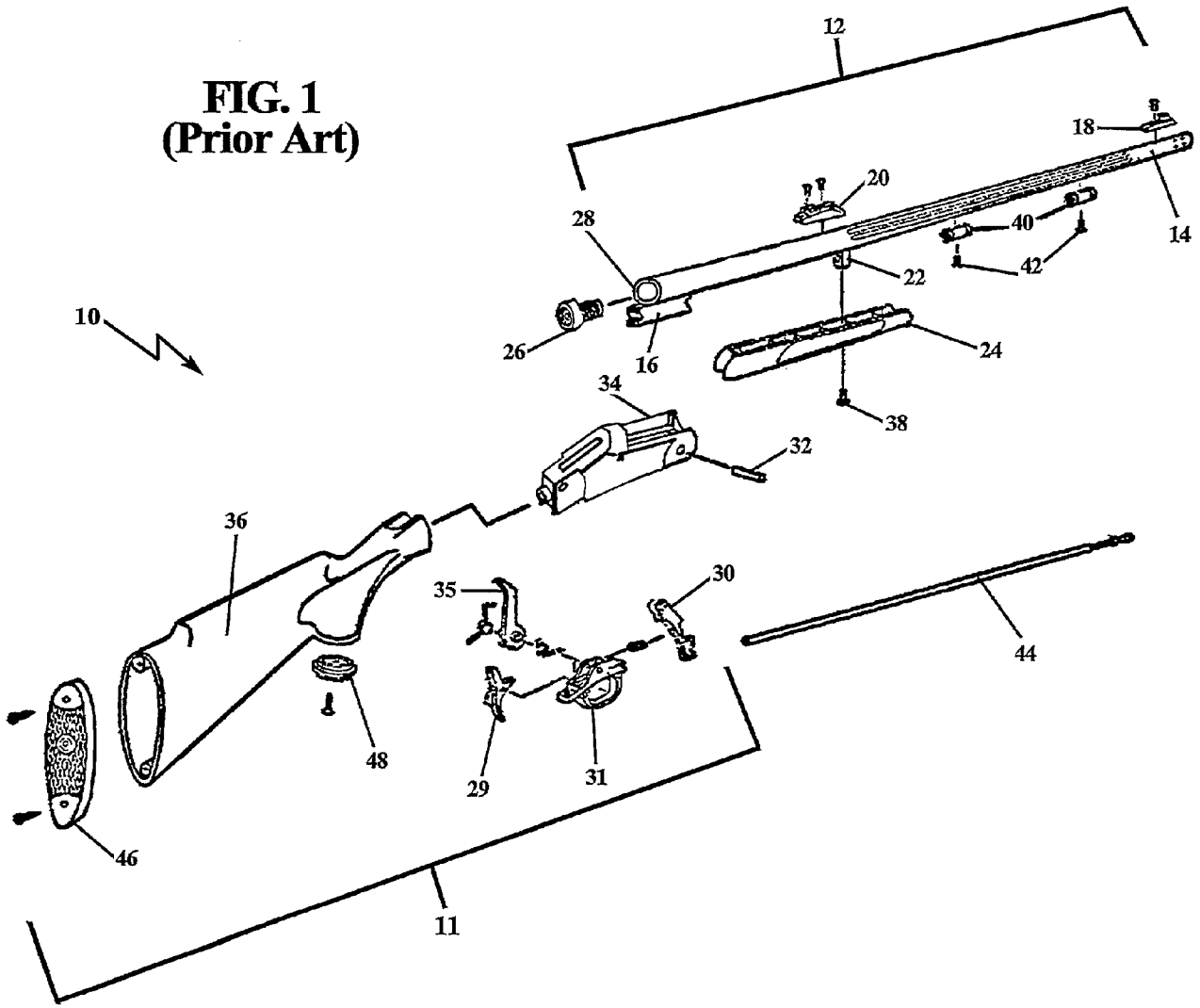
FIG. 1 (Prior Art)
FIG. 1 depicts an exploded view of a muzzleloader firearm of the prior art.

FIG. 1 depicts an exploded view of a muzzleloader firearm 10 of the prior art. This particular type of muzzleloader firearm includes a removable, rotatable barrel assembly 12 having a barrel 14 with a rearward barrel lug 16, a front sight 18, a rearward sight 20, and stock screw receiver 22 for attaching forend stock 24. Additionally, breech plug 26 is insertable within the breech end 28 of barrel 14. This exemplary muzzleloader depicts a firearm employing a break open system, that is, a firearm that allows for loading and unloading the gun by releasing the barrel assembly using a barrel catch 30 to release the hold on barrel lug 16, and rotating the barrel assembly about frame pivot pin 32, thus opening the gun. In this open position, the receiver or frame 34 is exposed and visible and remains attached with rear stock 36.

In assembly, forend stock screw 38 is secured within stock screw receiver 22 attaching forestock 24 to barrel 14. Front and rearward sights 18, 20 are attached by screws to barrel 14. Ramrod thimbles 40 are attached to the bottom of barrel 14 by thimble screws 42 for holding ramrod 44 in place. Rear stock 36 generally includes an attachable buttpad 46 and pistol grip cap 48. Trigger 29 is within trigger guard 31, which when assembled, are in mechanical communication with hammer or striker 35.

Figure 2:
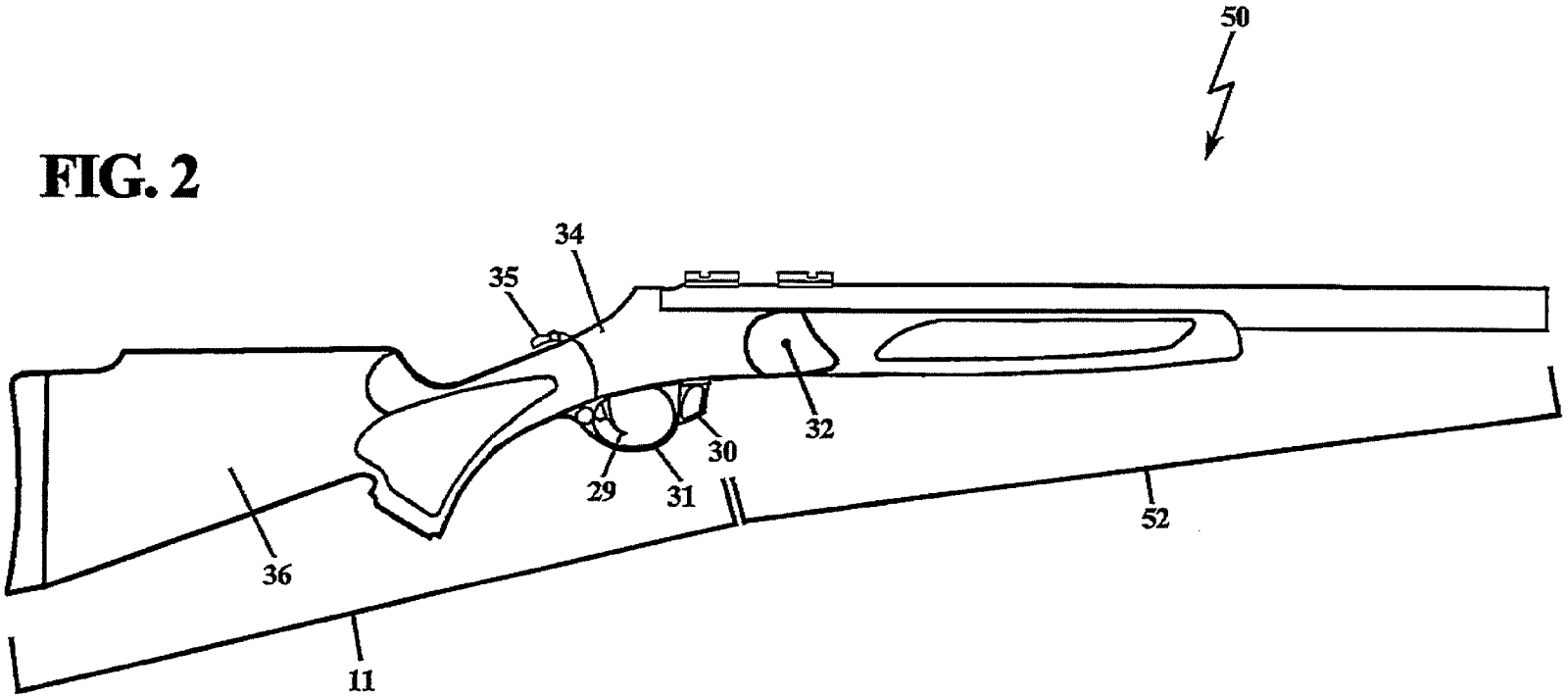
FIG. 2 depicts a side view of a converted arrow muzzleloader firearm of the present invention.

FIG. 2 depicts a side view of a converted arrow muzzleloader firearm 50 of the present invention. The stock assembly 11 of muzzleloader firearm 10 of FIG. 1 is retained while the barrel assembly 12 is completely removed, and replaced by an arrow barrel assembly 52. Although a break open muzzleloader firearm allows for an easy removal of a barrel assembly, which facilitates the conversion to an arrow gun, other muzzleloader firearms that are not break open may still be converted to a muzzleloader arrow gun; however, additional component replacement may be required. In a break open system, the removal of barrel assembly 12 is performed simply and quickly by the activation of barrel catch 30, which releases the rearward barrel lug 16, and is generally integral with the barrel assembly, allowing the muzzle end of barrel assembly 12 to be rotated downward about the stock assembly's frame 34 at frame pivot pin 32, thus exposing the top portion of frame 34. Barrel assembly 12 is easily separated from the stock assembly's frame 34 at frame pivot pin 32. Arrow barrel assembly 52 is then inserted in place of barrel assembly 12, and attached by a similarly shaped barrel lug 16' converting muzzleloader firearm 10 into an arrow muzzleloader firearm 50 capable of shooting an arrow.

The arrow muzzleloader firearm of the present invention is a conversion of muzzleloader firearm 10, utilizing the same stock assembly 11, including rear stock 36, frame 34, and firing action or mechanism components, such as striker 35, trigger 29, and associated springs and other firing action components. Stock assembly 11 preferably includes other components as well, such as a barrel catch 30, a trigger guard 31, and a sear (not shown), to name a few, but may include different components depending upon the type of muzzleloader firearm being converted. For example, in some instances a barrel catch 30 is used to release the barrel assembly from stock assembly 11. In a preferred conversion from muzzleloader to arrow gun, the muzzleloader stock assembly inclusive of all firing components is retained; only the muzzleloader shot barrel assembly is replaced for a barrel assembly capable of firing an arrow.

Figure 3:
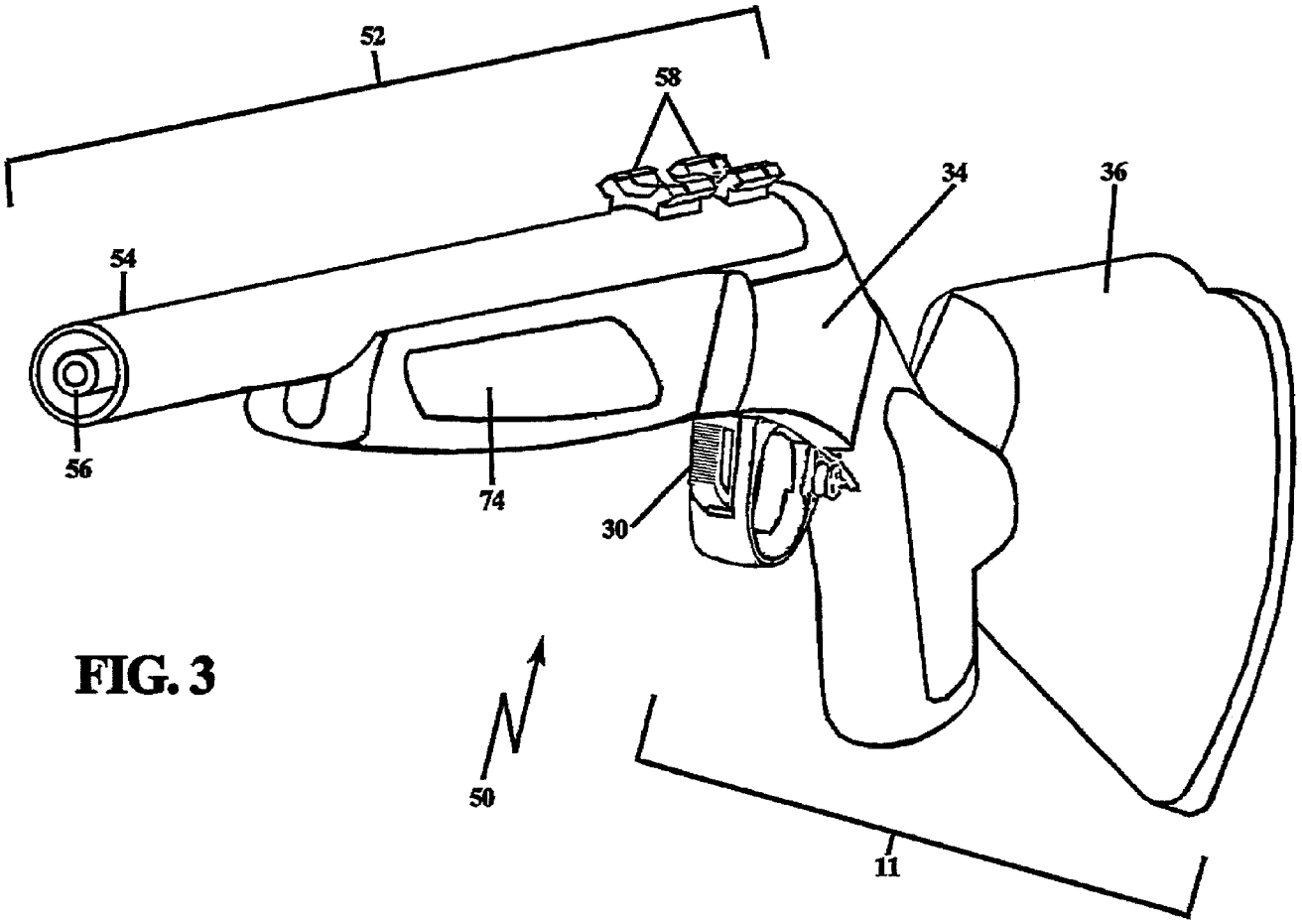
FIG. 3 is a forward perspective view of arrow muzzleloader firearm of FIG. 2.

FIG. 3 is a forward perspective view of arrow muzzleloader firearm 50. Arrow barrel assembly 52 includes at least an inner barrel tube 56, and may include an outer shroud 54 that houses an arrow that is coaxial with inner barrel tube 56, and inserted over inner barrel tube 56, such that the outer shroud encompasses the inner barrel tube. Arrow barrel assembly 52 may further include rearward scope mount base 58 and forend stock 74. Arrow barrel assembly 52 is attached to stock assembly 11 at frame 34 of muzzleloader firearm 10.

Figure 4A:
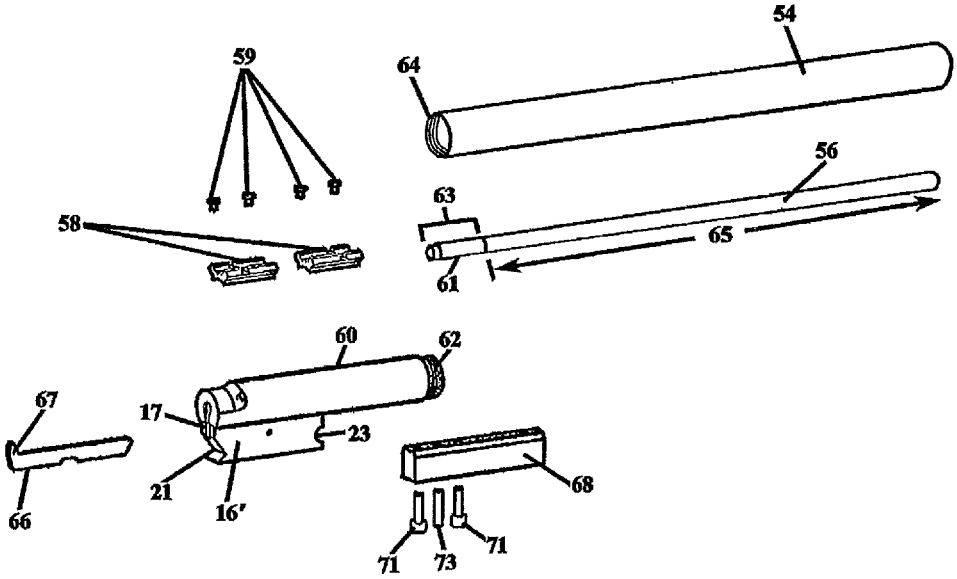
FIG. 4A is an exploded view of one embodiment of arrow barrel assembly of FIG. 2.

FIG. 4A is an exploded view of one embodiment of arrow barrel assembly 52. The assembly includes outer shroud 54 and inner barrel tube 56. Rearward scope mount base 58 is attached with attachment screws 59 to a monoblock 60, which in a preferred embodiment is a modified barrel segment or portion. Adjacent and preferably integral with monoblock 60 is a stock assembly attachment. In at least one embodiment the stock assembly attachment includes a rearward barrel lug 16' of a similar shape as rearward barrel lug 16 of muzzleloader firearm 10. Similar to barrel lug 16, rearward barrel lug 16' of arrow barrel assembly 52 includes angled cutout 21 for mating with a rotatable complementary securing portion at the top end of rotatable barrel catch 30, which is activated by pressing barrel catch 30 towards trigger 29, and at the forward end of rearward barrel lug 16', a curved or arcuate cutout 23 for attaching to, and rotating about, frame pivot pin 32.

Rearward barrel lug 16' may include a slot 17 for receiving an extractor 66, which is formed for a particular predetermined caliber charge, such as a .22 caliber blank cap. Extractor 66 includes a raised end 67, in slidable mechanical communication with a blank rimfire cap or power load rim of a particular predetermined caliber. The facing end of the monoblock breech end may have a machined, grooved surface for accepting the predetermined caliber blank rimfire cap or power load.

In at least one embodiment, the forward end of monoblock 60 is a barrel attachment. The barrel attachment includes a barrel segment portion with a threaded treated outer surface 62 at its forward end for receiving a threaded breech end 64 of an outer barrel or shroud 54.

In order to attach forend stock 74 (shown in FIG. 4B) to arrow barrel assembly 52 a fixation component 68 is utilized. Fixation component 68 includes an attachment block having apertures for receiving screws 71 and pin 73. This attachment scheme helps secure monoblock 60 to forend stock 72 (via forend stock screw 72).

Figure 4B:
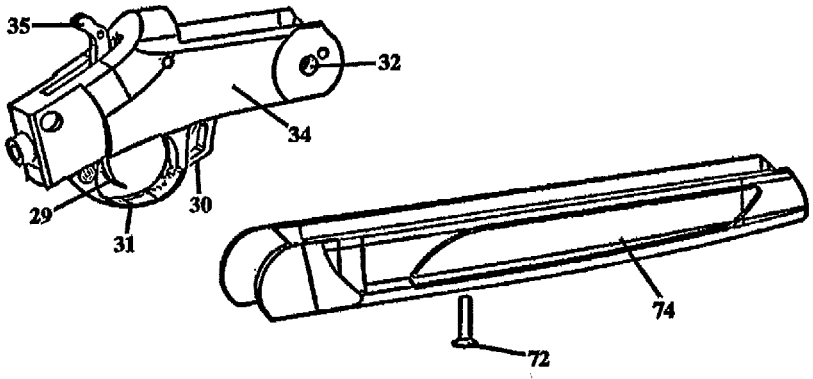
FIG. 4B depicts a forend stock with stock screw shown in an exploded view with the frame of a muzzleloader firearm.

FIG. 4B depicts forend stock 74 with stock screw 72 shown in an exploded view with frame 34. Frame 34 is the frame of muzzleloader firearm 10. It need not be converted or replaced when a user modifies a muzzleloader firearm with arrow barrel assembly 52.

Figure 5:
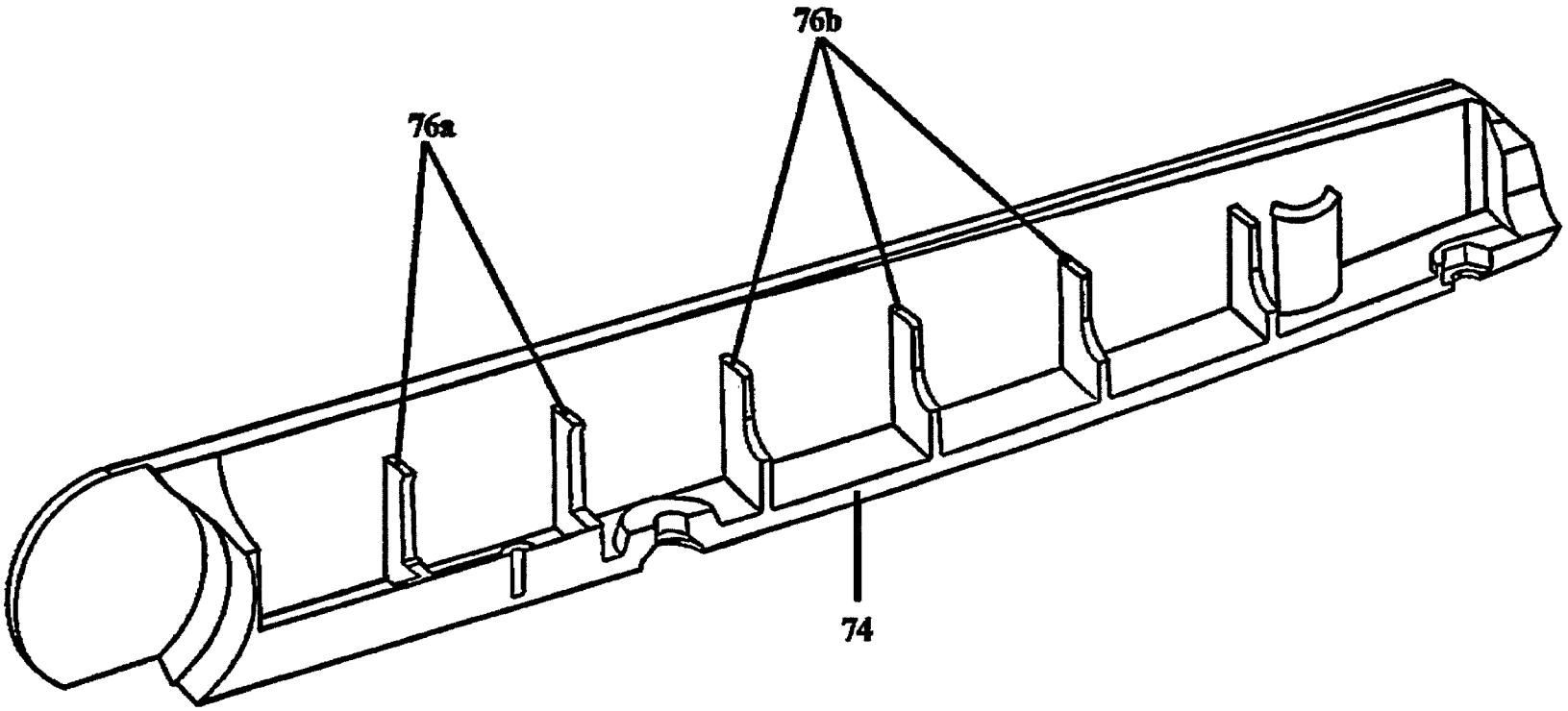
FIG. 5 depicts a perspective cross-sectional view of the forend stock of FIG. 4B with internal ribs formed to fit the arrow gun barrel assembly components.

FIG. 5 depicts a perspective cross-sectional view of forend stock 74 with internal ribs 76*a,b* formed to fit arrow gun components. Ribs 76*a* include straight edges to seat fixation component 68. Ribs 76*b* include curved edges to seat the circular barrel portion of monoblock 60 as well as outer shroud 54.

Figure 6:
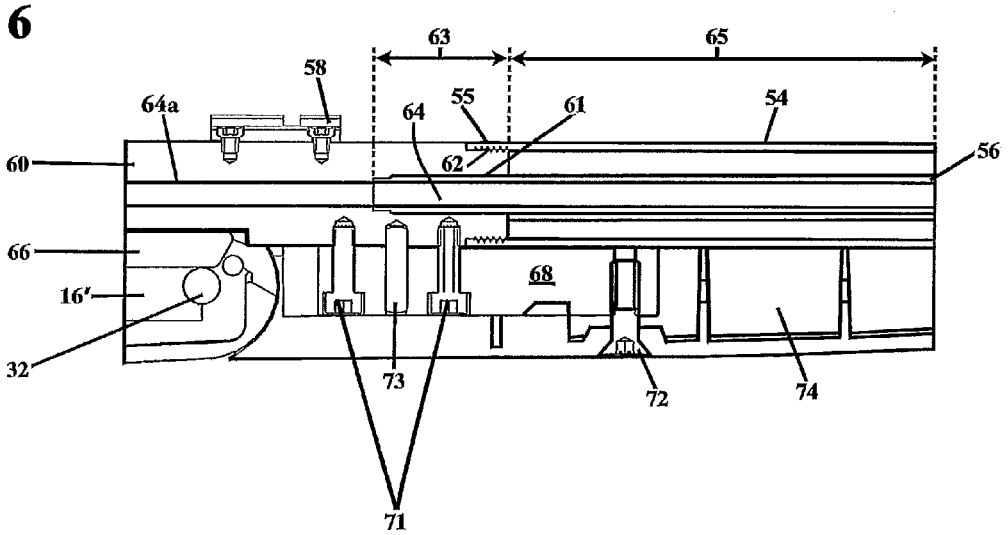
FIG. 6 is a partial cross-sectional view of the forend stock fixation component enclosed within forend stock.

FIG. 6 is a partial cross-sectional view of the forend stock fixation component 68 enclosed within forend stock 74. In at least one embodiment, the barrel attachment of monoblock 60 further includes a recess at its forward end for receiving inner barrel tube 56. Inner barrel tube 56 preferably includes a machined breech end having an outer surface 61 over a predetermined length 63 that is smaller in diameter than the remainder of the outer surface traversing length 65 of inner barrel tube 56. Inner barrel tube 56 may also be threaded at its breech end to be received by a complementary threaded portion within the barrel attachment at the forward end of monoblock 60, that is, within the recess.

Receiving screws 71 and pin 73 are shown inserted within and through fixation component 68, and into the barrel portion of monoblock 60. Threaded portion 62 of the barrel segment of monoblock 60 mates with a complementary threaded portion 55 at the breech end of outer shroud 54. In addition, monoblock 60 includes a formed recess 64 for insertion of inner barrel tube 56. Formed recess 64 includes at the forward end of monoblock 60 an outer diameter capable of securing, and holding tightly preferably by press fit, the breech end of inner barrel tube 56. Formed recess 64 includes a smaller diameter portion 64*a* beginning at the breech end of monoblock 60 and extending to the breech end of the press fit inner barrel tube 56, which effectively maintains the inner diameter of inner barrel tube 56 throughout monoblock 60. Although inner barrel tube 56 is preferably press fit within monoblock 60, it may also be fixed by threaded grooves without compromising its fit or function.

Figure 7:
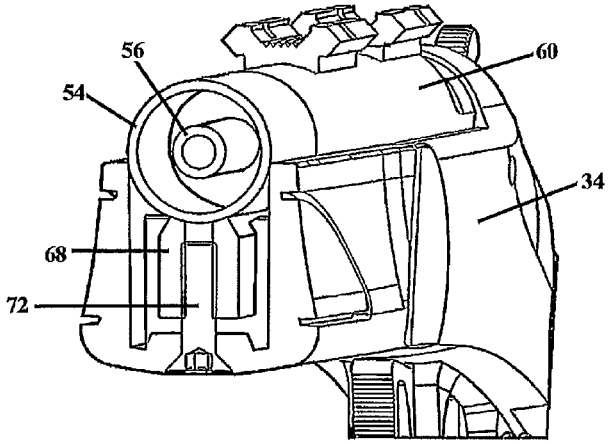
FIG. 7 is a perspective cross-sectional view of muzzleloader arrow gun at sectional line AA of FIG. 6.

FIG. 7 is a perspective cross-sectional view of muzzleloader arrow gun 50 at sectional line AA of FIG. 6. A portion of outer shroud 54 and inner barrel tube 56 are shown attached to the barrel segment of monoblock 60. The lower outer surface of outer shroud 54 is in contact with adjustable screw 72, which passes through, and is aligned by, fixation component 68. As shown, the components of fixation component 68 ensure that the barrel assembly 52 is secured to forend stock 74. In turn, monoblock 60 is configured to be rotatably attachable to frame 34 of the original muzzleloader firearm 10.

Figure 8:
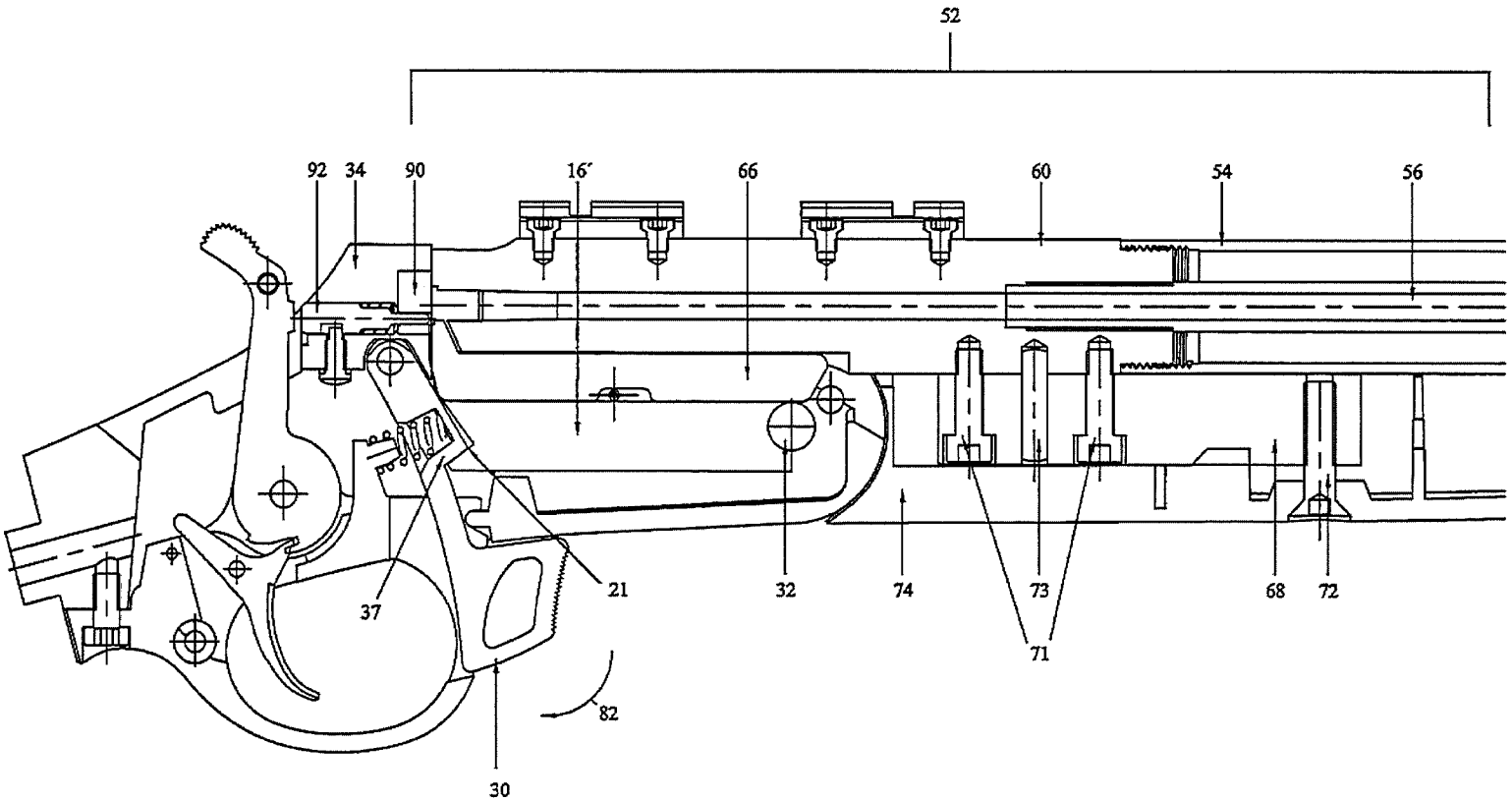
FIG. 8 depicts a partial cross-sectional view of muzzle loader arrow gun with the arrow barrel assembly attached.

FIG. 8 depicts a partial cross-sectional view of muzzleloader arrow gun 50 with arrow barrel assembly 52 attached. Fixation component 68 is depicted in place, securing arrow barrel assembly 52 and forend stock 74. The upper portion of barrel catch 30 includes an extended angled projection 37 to releasably engage angled cutout 21 of rearward barrel lug 16'. Rotation of barrel catch 30 in the direction of arrow 82 moves extended angled projection 37 away from angled cutout 21 of rearward barrel lug 16', thereby releasing arrow barrel assembly 52 from its breech end at frame 34, allowing arrow barrel assembly 52 to rotate about, and be removably detached from, frame pivot pin 32. This type of muzzleloader uses barrel catch 30 for locking the barrel when it is in a closed position, that is, the barrel catch inside frame 34 includes extended angled projection 37 to lock rearward barrel lug 16' in place. The portion of barrel catch 30 outside frame 34 is accessible to the user, and when pressed or rotated, releases the rearward portion of barrel lug 16' from extended angled projection 37.

In-line or break open muzzleloader firearms, in general, are centerfire devices, where the firing pin is centered about the barrel and strikes the center of the breech plug that supports a 209 primer. However, in at least one embodiment for arrow gun 50, a blank rim fire cap or power load is preferred. In order to accommodate a rimfire cap, such as a rim fire .22 caliber cap, the firing pin must be in proximity of a cap rim, not the cap center. The design of the arrow gun barrel assembly 52 accommodates this by locating the center axis of the inner barrel tube to a position that situates the firing pin closer to the cap rim. Thus, instead of the firing pin of a gun striking the primer cap at its center to ignite it (a centerfire configuration), the pin strikes the rim of the blank cap. The rim of a blank rimfire cap or power load is essentially an extended and widened cap which contains a powder propellant such as cordite, or the like.

Preferably, the rearward face of monoblock 60 includes a cylindrical recess coaxial with, and having a larger diameter than, the cylindrical cavity traversing through monoblock 60 for receiving the rim of a blank rimfire cap. A second cylindrical recess in the cylindrical cavity at the rearward end of monoblock 60 receives the blank rimfire cap's cylindrical body when the blank rimfire cap is inserted within the monoblock.

Figure 9:
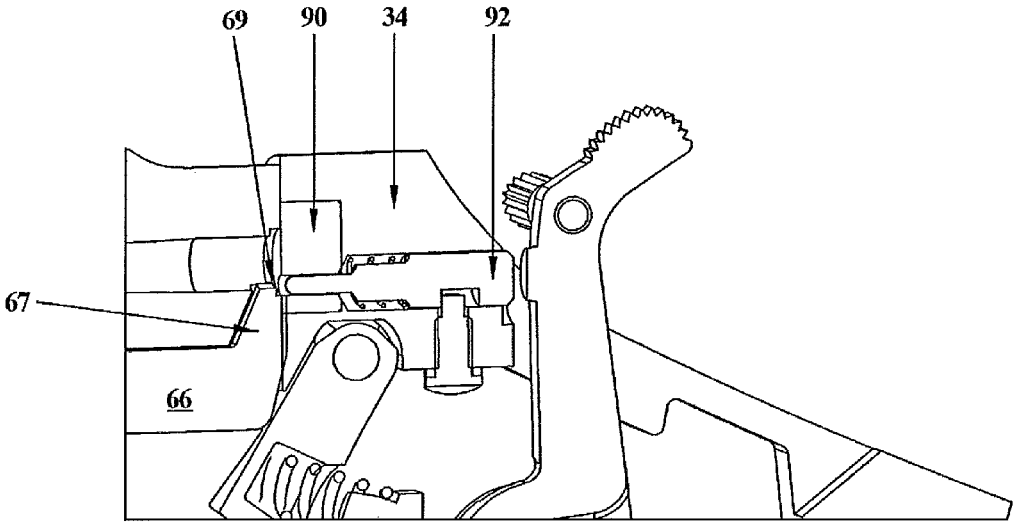
FIG. 9 depicts a partial, magnified view of the frame modified with a steel insert to accommodate firing pin alignment and rim firing.

In an alternate embodiment, along with the raising of the center axis of arrow gun barrel assembly, realigning the firing pin at the rim of the blank rimfire cap, the frame 34 may include a steel insert 90 that assists in firing pin 92 alignment. Extractor 66, which is preselected for a given blank cap rim, includes notch 69 in raised end 67 to assist in slidably communicating with the rim of the blank rimfire cap (not shown). FIG. 9 depicts a partial, magnified view of the frame modified with a steel insert to accommodate firing pin alignment and rim firing.

It is preferable to utilize rimfire cap blanks of the type commonly used in nail guns, referred to as power loads. A blank is a charged cartridge that does not contain a projectile. To contain the propellant, the opening where the projectile would normally be located is crimped shut and or is sealed with some material that disperses rapidly upon leaving the barrel. For example, blanks of a rimfire .22 caliber could be used to propel an arrow. In order to ensure that only blanks are accepted by monoblock 60, the breech end recess of monoblock 60 includes tiered recesses of predetermined diameters that are designed to accept only a blank or power load and not a bullet cartridge, thus providing an additional user safety feature that ensures the firearm cannot be used to discharge bullets that are not muzzle loaded.

Figure 10:
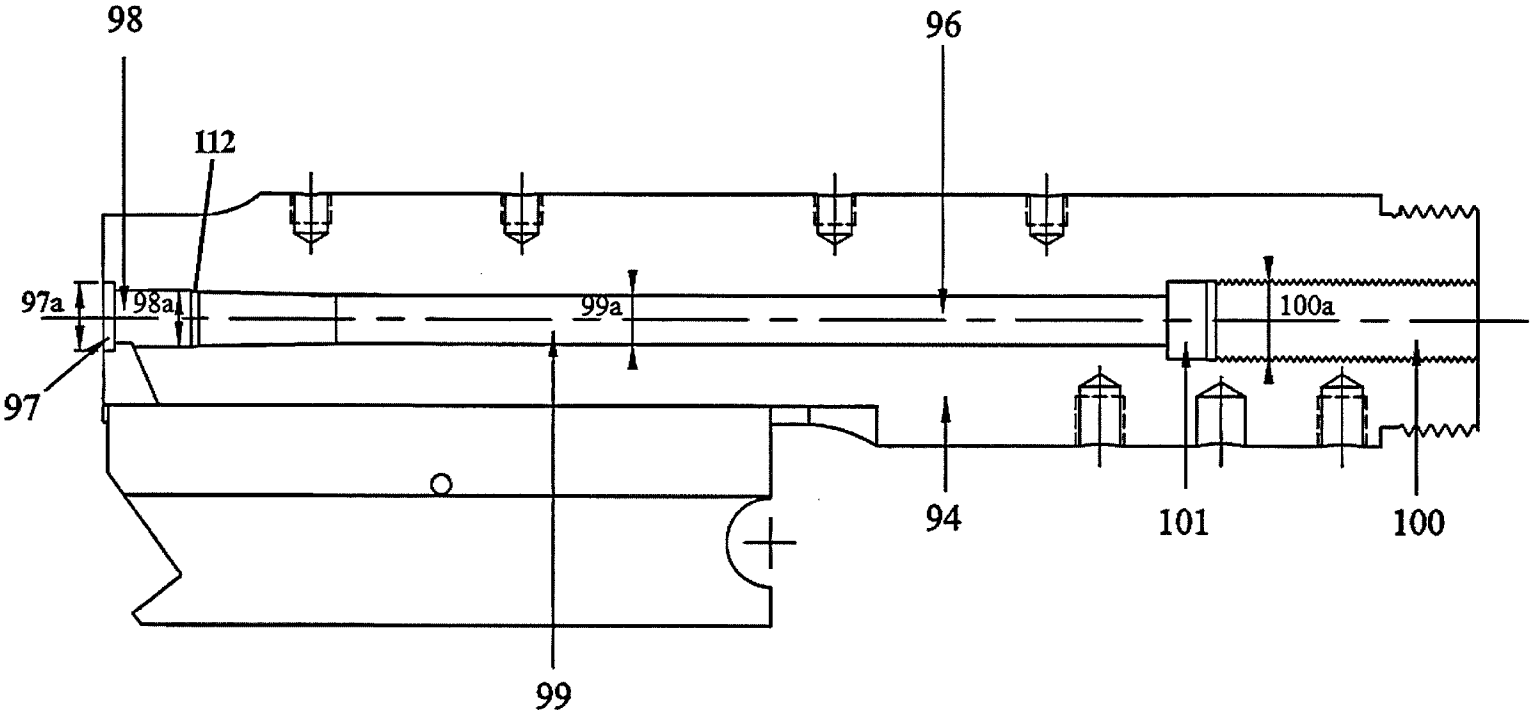
FIG. 10 depicts an embodiment of the monoblock, which is essentially a barrel segment connected to, or integral with, a barrel lug.

FIG. 10 depicts an embodiment of the monoblock, which is essentially a barrel segment or portion connected to, or integral with, a barrel lug. Barrel segment 94 includes a cylindrical cavity 98 that traverses into the device, having a uniquely shaped rearward or breech end, and a uniquely shaped forward end. At the breech end, barrel segment 94 includes a set of tiered coaxial recesses formed specifically to receive a blank cartridge. The breech end of barrel segment 94 combines three separate coaxial, cylindrical recesses or cylindrical spaces, each having separate diameters. The first cylindrical space 97 is of a first diameter 97*a* large enough to receive the rim portion of a blank and hold the rim portion in place when the firing pin strikes it. This first recess or cylindrical space 97 presents a secure holding place for the rim portion of the blank. The second cylindrical space 98 of the set of tiered coaxial recesses is coaxial with first cylindrical space 97 and has a diameter 98*a* that is less than first cylindrical space diameter 97*a*. This second cylindrical space 98 receives the body of a power load or blank rimfire cap. The second cylindrical space 98 tapers 112 to the innermost diameter, cylindrical space 99, of the set of tiered coaxial recesses. Cylindrical space 99 having diameter 99*a*, which is the smallest of the diameters. Diameter 99*a* preferably represents the exiting diameter of the propellant gases from a blank rimfire cap, and is approximately the same diameter as the inner diameter of the inner barrel tube 56 (not shown).

At the forward end of monoblock 94, a larger insert portion 100 is located to receive the inner barrel tube 56. The diameter 100*a* of aperture 100 is matched to the outer diameter of the inner barrel tube. Preferably, the inner diameter of the inner barrel tube is the same diameter as the innermost diameter 99*a* of the set of tiered coaxial recesses to allow for a continuous, uninterrupted flow of propellant gases upon discharge. In FIG. 10, aperture 100 is shown with a threaded end 101 therein for receiving a threaded end of the inner barrel tube, although a pressed fit, as depicted above may be utilized instead.

Figure 11:
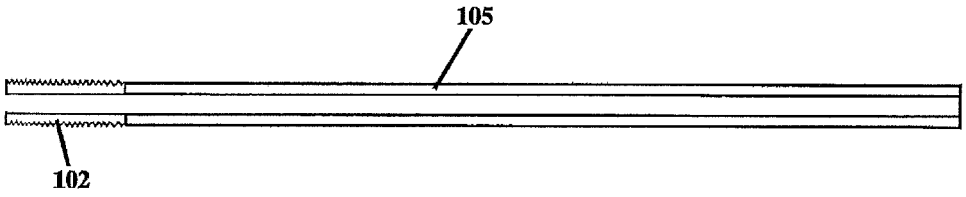
FIG. 11 depicts an inner barrel tube for mating with the monoblock of FIG. 10.

FIG. 11 depicts an inner barrel tube 105 for mating with the monoblock of FIG. 10. Inner barrel tube 105 includes threaded portion 102 to complementary mate with threaded end of aperture 100 of barrel segment 94.

In order to efficiently propel an arrow from the converted muzzleloader firearm of the present invention, the arrow must include a hollow core of a diameter slightly larger than the outer diameter of the inner barrel tube 56, so that the arrow fits, preferably in a snug fit, over inner barrel tube 56 and is quickly projected away from inner barrel tube 56 when the primer cap is ignited and the propellant gases are projected out of the forward or muzzle end of the inner barrel tube.

Figure 12:
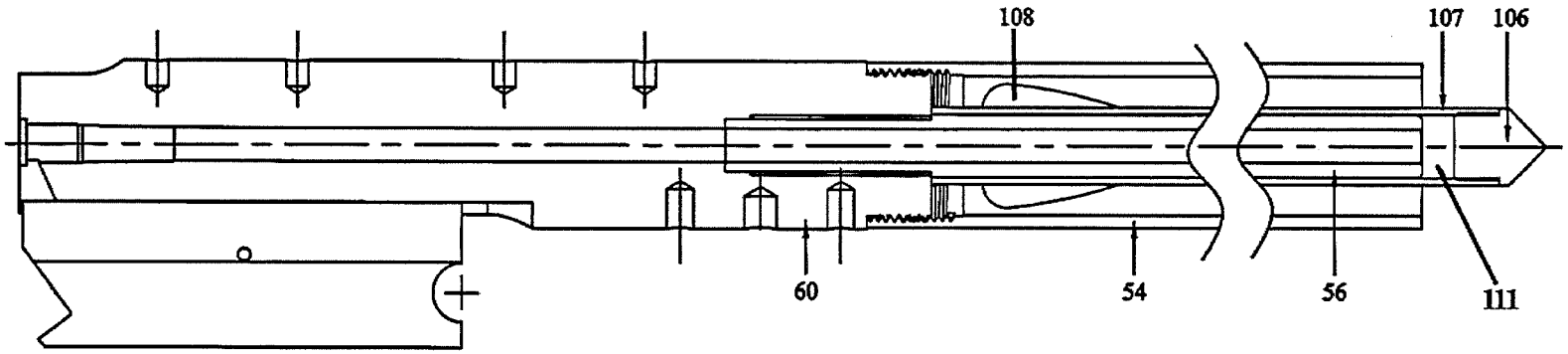
FIG. 12 depicts a portion of the arrow barrel assembly with an arrow inserted.

FIG. 12 depicts a portion of the arrow barrel assembly with an arrow inserted. Arrow 111 has a hollow body segment represented by barrel 107 and terminates in metal tip 106. Metal tip 106 receives the pulse load from a cartridge during firing. Barrel 107 fits over barrel tube 56 in a snug-fit configuration. Stabilizing feathers 108 fit within outer shroud 54.

The present invention provides an arrow barrel assembly that allows for the immediate conversion of a muzzleloader firearm to a firearm capable of shooting an arrow. The method of conversion is greatly simplified by retaining all of the firing components of the muzzleloader firearm including the stock and frame, and then replacing the muzzleloader firearm barrel assembly with a new arrow barrel assembly as discussed above capable of firing an arrow. The method may further be modified to incorporate a steel insert within the muzzleloader firearm stock and frame assembly to assist in aligning the firing pin with a blank rimfire cap.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A muzzleloader arrow gun comprising:

a break open muzzleloader firearm stock assembly of a muzzleloader firearm, said muzzleloader firearm stock assembly having a frame, a muzzleloader firing action, and a rear stock; and an arrow barrel assembly having a rearward end and a forward end, releasably attachable to said muzzleloader stock assembly, said arrow barrel assembly replacing a muzzleloader barrel assembly of said muzzleloader firearm, said arrow barrel assembly including:

a stock assembly attachment at said arrow barrel assembly rearward end for releasably engaging said stock assembly of said muzzleloader firearm;

a barrel attachment; and a barrel tube having open ends, an inner diameter, and an outer diameter, releasably engaging said barrel attachment, said outer diameter of said barrel tube adapted to fit within an arrow shaft having a hollow inner core, wherein said inner diameter of said barrel tube has a center axis located at a position that situates a firing pin of said muzzleloader firearm closer to a blank cap rim.

2. The muzzleloader arrow gun of claim 1 wherein said arrow barrel assembly includes an outer shroud releasably engaging said barrel attachment, said outer shroud coaxial with said barrel tube and having a larger diameter than said outer diameter of said barrel tube.

3. The muzzleloader arrow gun of claim 1 wherein said barrel attachment includes a barrel segment having a rearward end, a rearward end face, a forward end, and a cylindrical cavity traversing from said barrel segment rearward end to said barrel segment forward end, said cylindrical cavity having a cylindrical cavity diameter, and being coaxially aligned with said barrel tube inner diameter, said barrel segment rearward end face having a first cylindrical recess larger than and coaxial with said cylindrical cavity for receiving a blank cap, said cylindrical cavity having a second cylindrical recess of a diameter smaller than said first cylindrical recess and larger than said cylindrical cavity diameter for receiving a blank cap cylindrical body when said blank cap is inserted within said first cylindrical recess.

4. The muzzleloader arrow gun of claim 3 including a barrel lug fixedly attached to said barrel segment for securing said arrow barrel assembly to said muzzleloader stock assembly, said barrel lug having an angular cutout in a rearward end for engaging a complementary angular projection of an upper portion of a rotatable barrel catch of said stock assembly, and an arcuate cutout in a forward end for rotatably engaging a pivot pin on said frame of said stock assembly.

5. The muzzleloader arrow gun of claim 3 including a fixation component for attaching a forend stock to said arrow barrel assembly, said fixation component having apertures for receiving screws, pins, or any combination thereof, for attachment.

6. The muzzleloader arrow gun of claim 3 wherein said second cylindrical recess is joined to said first cylindrical recess by a tapered barrel segment.

7. A muzzleloader arrow gun comprising:

a break open muzzleloader firearm stock assembly of a muzzleloader firearm, said muzzleloader firearm stock assembly having a frame, a muzzleloader firing action, and a rear stock; and an arrow barrel assembly having a rearward end and a forward end, releasably attachable to said muzzleloader stock assembly, said arrow barrel assembly replacing a muzzleloader barrel assembly of said muzzleloader firearm, said arrow barrel assembly including:

a stock assembly attachment at said arrow barrel assembly rearward end for releasably engaging said stock assembly of said muzzleloader firearm;

a barrel attachment including a barrel segment having a rearward end, a rearward end face, a forward end, and a cylindrical cavity traversing from said barrel segment rearward end to said barrel segment forward end, said cylindrical cavity having a cylindrical cavity diameter, and being coaxially aligned with said barrel tube inner diameter, said barrel segment rearward end face having a first cylindrical recess larger than and coaxial with said cylindrical cavity for receiving a blank cap, said cylindrical cavity having a second cylindrical recess of a diameter smaller than said first cylindrical recess and larger than said cylindrical cavity diameter for receiving a blank cap cylindrical body when said blank cap is inserted within said first cylindrical recess, said barrel segment forward end forming said barrel attachment for securing said barrel segment to said barrel tube, said forward end of said barrel segment having a cylindrical recess coaxial with and having a diameter equal to or larger than said barrel tube outer diameter; and a barrel tube having open ends, an inner diameter, and an outer diameter, releasably engaging said barrel attachment, said outer diameter of said barrel tube adapted to fit within an arrow shaft having a hollow inner core.

8. The muzzleloader arrow gun of claim 7 wherein said barrel segment forward end includes an outer surface having threaded grooves for receiving complementary threaded grooves of an outer shroud, said outer shroud releasably engaging said barrel segment.

* * * * *